US008974198B2

(12) United States Patent
Schaefer et al.

(10) Patent No.: US 8,974,198 B2
(45) Date of Patent: Mar. 10, 2015

(54) COMPRESSOR HAVING COUNTERWEIGHT COVER

(75) Inventors: James A. Schaefer, Troy, OH (US); Stephen M. Seibel, Celina, OH (US); Daniel L. McSweeney, Sidney, OH (US); Robert J. Comparin, Camden, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 379 days.

(21) Appl. No.: 12/852,757

(22) Filed: Aug. 9, 2010

(65) Prior Publication Data

US 2011/0033324 A1 Feb. 10, 2011

Related U.S. Application Data

(60) Provisional application No. 61/232,626, filed on Aug. 10, 2009.

(51) Int. Cl.

| | |
|---|---|
| ***F04B 35/04*** | (2006.01) |
| ***F04C 18/063*** | (2006.01) |
| ***F04C 18/02*** | (2006.01) |
| ***F04C 23/00*** | (2006.01) |

(52) U.S. Cl.

CPC ..... *F04C 18/0215* (2013.01); *F04C 23/008* (2013.01); *F04C 2240/80* (2013.01)

USPC ..... 417/423.7; 418/55.6; 417/423.8

(58) Field of Classification Search

CPC ... F04C 29/026; F04C 29/028; F04C 29/0021

USPC ..... 417/410.5, 902, 410.1, 366, 423.7, 417/423.14; 418/55.1–55.6, 151; 55/462

See application file for complete search history.

(56) References Cited

U.S. PATENT DOCUMENTS

| | | | | |
|---|---|---|---|---|
| 2,245,498 | A | | 6/1941 | Pringiers |
| 2,949,975 | A | | 8/1960 | Plummer |
| 3,418,936 | A | * | 12/1968 | Dowdican et al. ..... 417/38 |
| 3,589,971 | A | | 6/1971 | Reed |
| 3,881,569 | A | | 5/1975 | Evans, Jr. |
| 4,168,726 | A | | 9/1979 | Klennert |
| 4,258,821 | A | | 3/1981 | Wendt et al. |

(Continued)

FOREIGN PATENT DOCUMENTS

| | | | |
|---|---|---|---|
| CA | 2 306 880 | A1 | 5/1999 |
| CN | 101153593 | A | 4/2008 |

(Continued)

OTHER PUBLICATIONS

International Search Report regarding Application No. PCT/US2010/044970, mailed Apr. 1, 2011.

(Continued)

*Primary Examiner* — Charles Freay
*Assistant Examiner* — Alexander Comley
(74) *Attorney, Agent, or Firm* — Harness, Dickey & Pierce, P.L.C.

(57) ABSTRACT

A counterweight cover for a compressor is provided and may include an annular body having a recess at least partially defined by an outer circumferential portion, an inner circumferential portion, and an upper portion connecting the outer circumferential portion and the inner circumferential portion. A suction baffle may be disposed on the annular body and may direct a flow of suction gas within the compressor.

33 Claims, 9 Drawing Sheets

(56) References Cited

U.S. PATENT DOCUMENTS

| | | | | | |
|---|---|---|---|---|---|
| 4,391,322 | A | | 7/1983 | Ciarlei et al. | |
| 4,442,585 | A | | 4/1984 | McGehee, Sr. et al. | |
| 4,615,411 | A | | 10/1986 | Breitscheidel et al. | |
| 4,767,293 | A | * | 8/1988 | Caillat et al. | 418/55.3 |
| 4,879,847 | A | | 11/1989 | Butzen et al. | |
| 4,885,561 | A | * | 12/1989 | Veverka et al. | 337/190 |
| 4,892,413 | A | | 1/1990 | Vats | |
| 4,895,496 | A | | 1/1990 | Elson | |
| 4,915,554 | A | | 4/1990 | Serizawa et al. | |
| 4,934,905 | A | * | 6/1990 | Richardson, Jr. | 417/372 |
| 4,971,529 | A | | 11/1990 | Gannaway et al. | |
| 4,991,406 | A | | 2/1991 | Fujii et al. | |
| 5,007,809 | A | * | 4/1991 | Kimura et al. | 417/371 |
| 5,030,073 | A | | 7/1991 | Serizawa et al. | |
| 5,055,010 | A | * | 10/1991 | Logan | 417/410.5 |
| 5,056,516 | A | * | 10/1991 | Spehr | 607/2 |
| 5,064,356 | A | * | 11/1991 | Horn | 417/410.5 |
| 5,108,274 | A | | 4/1992 | Kakuda et al. | |
| 5,110,268 | A | * | 5/1992 | Sakurai et al. | 417/410.5 |
| 5,114,322 | A | * | 5/1992 | Caillat et al. | 418/55.6 |
| 5,117,642 | A | | 6/1992 | Nakanishi et al. | |
| 5,125,241 | A | | 6/1992 | Nakanishi et al. | |
| 5,151,018 | A | | 9/1992 | Clendenin et al. | |
| 5,169,025 | A | | 12/1992 | Guo | |
| 5,219,281 | A | * | 6/1993 | Caillat et al. | 418/55.6 |
| 5,220,811 | A | | 6/1993 | Harper et al. | |
| 5,240,391 | A | * | 8/1993 | Ramshankar et al. | 417/410.1 |
| 5,255,161 | A | | 10/1993 | Knoll et al. | |
| 5,272,285 | A | | 12/1993 | Miller | |
| 5,274,200 | A | | 12/1993 | Das et al. | |
| 5,288,211 | A | | 2/1994 | Fry | |
| 5,339,652 | A | | 8/1994 | Dreiman | |
| 5,366,352 | A | * | 11/1994 | Deblois et al. | 417/292 |
| 5,386,702 | A | | 2/1995 | Wiesen | |
| 5,432,306 | A | | 7/1995 | Pfordresher | |
| 5,439,361 | A | * | 8/1995 | Reynolds et al. | 418/55.6 |
| 5,476,369 | A | | 12/1995 | Fowlkes et al. | |
| 5,495,885 | A | | 3/1996 | Fowlkes et al. | |
| 5,507,151 | A | | 4/1996 | Ring et al. | |
| 5,591,018 | A | * | 1/1997 | Takeuchi et al. | 417/366 |
| 5,597,293 | A | * | 1/1997 | Bushnell et al. | 417/410.3 |
| 5,622,662 | A | | 4/1997 | Veiga et al. | |
| 5,645,408 | A | | 7/1997 | Fujio et al. | |
| 5,669,232 | A | | 9/1997 | Iwamoto et al. | |
| 5,720,632 | A | | 2/1998 | Viklund | |
| 5,772,411 | A | * | 6/1998 | Crum et al. | 417/368 |
| 5,921,420 | A | | 7/1999 | Gordon et al. | |
| 5,931,649 | A | * | 8/1999 | Caillat et al. | 418/55.1 |
| 5,945,643 | A | | 8/1999 | Casser | |
| 5,965,851 | A | | 10/1999 | Herreman et al. | |
| 6,000,917 | A | * | 12/1999 | Smerud et al. | 417/368 |
| 6,033,756 | A | | 3/2000 | Handscomb | |
| 6,036,047 | A | | 3/2000 | Dobbie | |
| 6,062,033 | A | | 5/2000 | Choi | |
| 6,095,765 | A | | 8/2000 | Khalifa | |
| 6,135,727 | A | * | 10/2000 | Dreiman et al. | 417/415 |
| 6,139,295 | A | | 10/2000 | Utter et al. | |
| 6,152,259 | A | | 11/2000 | Freist et al. | |
| 6,168,404 | B1 | | 1/2001 | Gatecliff | |
| 6,174,149 | B1 | | 1/2001 | Bush | |
| 6,267,565 | B1 | | 7/2001 | Seibel et al. | |
| 6,280,155 | B1 | | 8/2001 | Dreiman | |
| 6,302,466 | B1 | | 10/2001 | Zwick | |
| 6,315,536 | B1 | * | 11/2001 | DeVore et al. | 418/55.6 |
| 6,402,485 | B2 | * | 6/2002 | Hong et al. | 417/366 |
| 6,406,266 | B1 | * | 6/2002 | Hugenroth et al. | 417/44.1 |
| 6,422,842 | B2 | * | 7/2002 | Sheridan et al. | 418/55.1 |
| 6,454,538 | B1 | * | 9/2002 | Witham et al. | 417/32 |
| 6,474,964 | B2 | * | 11/2002 | De Bernardi et al. | 418/55.6 |
| 6,584,949 | B1 | | 7/2003 | Franchi et al. | |
| 6,680,550 | B2 | | 1/2004 | Matsunaga et al. | |
| 6,722,466 | B1 | | 4/2004 | Tong et al. | |
| 6,766,879 | B2 | | 7/2004 | Eilers | |
| 6,872,057 | B2 | | 3/2005 | Kim | |
| 6,887,050 | B2 | | 5/2005 | Haller | |
| 6,893,711 | B2 | | 5/2005 | Williamson et al. | |
| 6,896,496 | B2 | * | 5/2005 | Haller et al. | 418/55.1 |
| 6,932,190 | B2 | | 8/2005 | Sishtla | |
| 6,981,386 | B2 | | 1/2006 | Young et al. | |
| 7,018,183 | B2 | | 3/2006 | Haller et al. | |
| 7,018,184 | B2 | * | 3/2006 | Skinner et al. | 418/55.1 |
| 7,063,518 | B2 | * | 6/2006 | Skinner et al. | 417/410.1 |
| 7,063,523 | B2 | | 6/2006 | Skinner | |
| 7,094,043 | B2 | * | 8/2006 | Skinner | 418/55.6 |
| 7,162,797 | B2 | | 1/2007 | Sowa et al. | |
| 7,163,383 | B2 | | 1/2007 | Skinner | |
| 7,278,834 | B2 | | 10/2007 | Herrick et al. | |
| 7,318,710 | B2 | | 1/2008 | Lee et al. | |
| 7,357,219 | B2 | | 4/2008 | Mafi et al. | |
| 7,371,059 | B2 | | 5/2008 | Ignatiev et al. | |
| 7,384,250 | B2 | * | 6/2008 | Shin et al. | 418/55.6 |
| 7,398,855 | B2 | | 7/2008 | Seel | |
| 7,481,296 | B2 | | 1/2009 | Eilers | |
| 2001/0006603 | A1 | | 7/2001 | Hong et al. | |
| 2001/0055536 | A1 | | 12/2001 | Bernardi et al. | |
| 2002/0108807 | A1 | | 8/2002 | Murakami et al. | |
| 2004/0047754 | A1 | * | 3/2004 | Gopinathan | 418/55.6 |
| 2004/0057843 | A1 | | 3/2004 | Haller et al. | |
| 2004/0057849 | A1 | | 3/2004 | Skinner et al. | |
| 2004/0057857 | A1 | * | 3/2004 | Skinner | 418/55.6 |
| 2004/0126247 | A1 | | 7/2004 | Broser et al. | |
| 2004/0126258 | A1 | | 7/2004 | Lai et al. | |
| 2004/0166008 | A1 | | 8/2004 | Lai et al. | |
| 2004/0170509 | A1 | * | 9/2004 | Wehrenberg et al. | 417/371 |
| 2005/0056481 | A1 | | 3/2005 | Mafi et al. | |
| 2006/0078452 | A1 | | 4/2006 | Park et al. | |
| 2006/0127262 | A1 | | 6/2006 | Shin et al. | |
| 2006/0177335 | A1 | | 8/2006 | Hwang et al. | |
| 2006/0222545 | A1 | | 10/2006 | Nam et al. | |
| 2006/0222546 | A1 | | 10/2006 | Lee et al. | |
| 2006/0245967 | A1 | * | 11/2006 | Gopinathan | 418/55.4 |
| 2007/0003424 | A1 | * | 1/2007 | Benco et al. | 418/55.3 |
| 2007/0183914 | A1 | | 8/2007 | Gopinathan | |
| 2007/0237664 | A1 | | 10/2007 | Joo et al. | |
| 2008/0099275 | A1 | | 5/2008 | Seel | |
| 2008/0173497 | A1 | | 7/2008 | Kalinova et al. | |
| 2008/0175738 | A1 | * | 7/2008 | Jung et al. | 418/55.6 |
| 2008/0317614 | A1 | | 12/2008 | Horiba et al. | |
| 2009/0200076 | A1 | * | 8/2009 | Reynolds et al. | 174/659 |
| 2009/0238704 | A1 | | 9/2009 | Sakamoto et al. | |
| 2010/0021330 | A1 | | 1/2010 | Haller | |

FOREIGN PATENT DOCUMENTS

| | | | |
|---|---|---|---|
| JP | 63259102 | A | 10/1988 |
| JP | 02294581 | A | 12/1990 |
| JP | 02298685 | A | 12/1990 |

OTHER PUBLICATIONS

Written Opinion of the International Searching Authority regarding Application No. PCT/US2010/044970, mailed Apr. 1, 2011.

First Office Action regarding Chinese Patent Application No. 201080040227.9, dated Jan. 23, 2014, and Search Report. English translation provided by Unitalen Attorneys at Law.

* cited by examiner

COMPRESSOR HAVING COUNTERWEIGHT COVER

CROSS-REFERENCE TO RELATED APPLICATIONS

This application claims the benefit of U.S. Provisional Application No. 61/232,626 filed on Aug. 10, 2009. The entire disclosure of the above application is incorporated herein by reference.

FIELD

The present disclosure relates to a compressor and more particularly to a compressor having a counterweight cover.

BACKGROUND

This section provides background information related to the present disclosure which is not necessarily prior art.

Cooling systems, refrigeration systems, heat-pump systems, and other climate-control systems typically include a condenser, an evaporator, an expansion device disposed between the condenser and evaporator, and a compressor circulating fluid between the condenser and the evaporator. The compressor may be one of any number of different compressors. For example, the compressor may be a reciprocating compressor or a scroll compressor that selectively circulates fluid among the various components of a cooling, refrigeration, or heat-pump system. Regardless of the particular type of compressor employed, consistent and reliable operation of the compressor is required to ensure that the cooling, refrigeration, or heat-pump system in which the compressor is installed is capable of consistently and reliably providing a cooling and/or heating effect on demand.

Compressors of the type described above often include a compression mechanism that compresses the fluid, thereby circulating the fluid within the refrigeration, cooling, or heat-pump system. Depending on the particular type of compressor, a drive shaft may be used to impart a force on and drive the compression mechanism. In order to reduce vibration of the compressor, such a drive shaft may include one or more counterweights that are sized and positioned relative to the drive shaft to rotationally balance the drive shaft. While the counterweight improves operation of the drive shaft and, thus, the compression mechanism, rotation of the counterweight may cause undesirable windage and/or oil circulation due to rotation within a shell of the compressor. Excessive oil circulation reduces the overall efficiency of the cooling, refrigeration, or heat-pump system, as oil within each system prevents optimal heat transfer within the condenser unit and evaporator unit of each system.

SUMMARY

This section provides a general summary of the disclosure, and is not a comprehensive disclosure of its full scope or all of its features.

A counterweight cover for a compressor is provided and may include an annular body having a recess at least partially defined by an outer circumferential portion, an inner circumferential portion, and an upper portion connecting the outer circumferential portion and the inner circumferential portion. A suction baffle may be disposed on the annular body and may direct a flow of suction gas within the compressor.

A compressor is provided and may include a motor assembly at least partially supported by a main-bearing housing, a counterweight associated with the motor assembly, and a counterweight cover fixed to the main-bearing housing and at least partially covering the counterweight. At least one anti-rotation feature may prevent relative rotation between the counterweight cover and the main-bearing housing.

A compressor is provided and may include a motor assembly at least partially supported by a main-bearing housing, a counterweight associated with the motor assembly, and a counterweight cover fixed to the main-bearing housing and at least partially covering the counterweight. A suction baffle may be integrally formed with the counterweight cover and a wire guide may be integrally formed with the counterweight cover.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
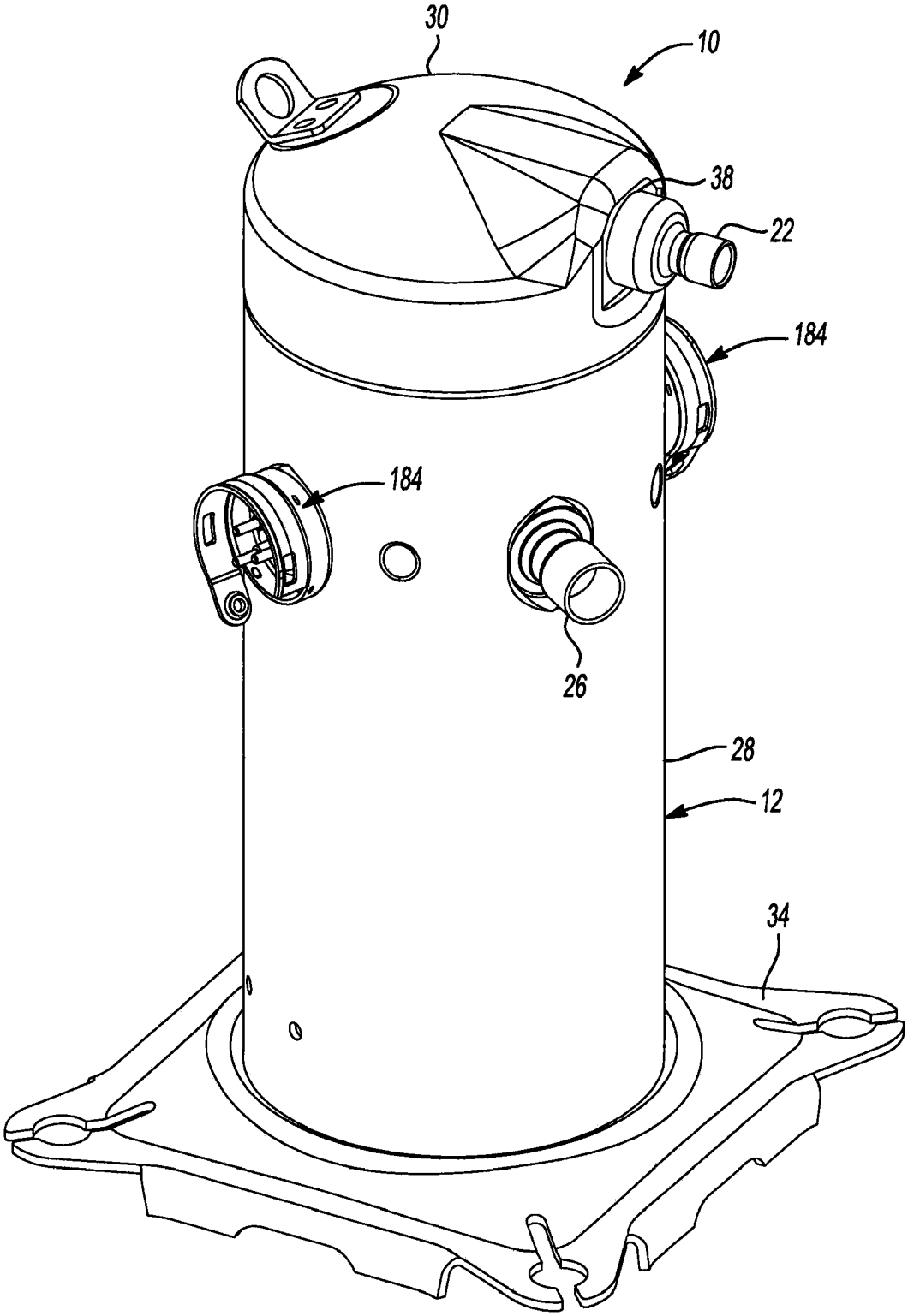
FIG. 1 is a perspective view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth, such as examples of specific components and devices, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
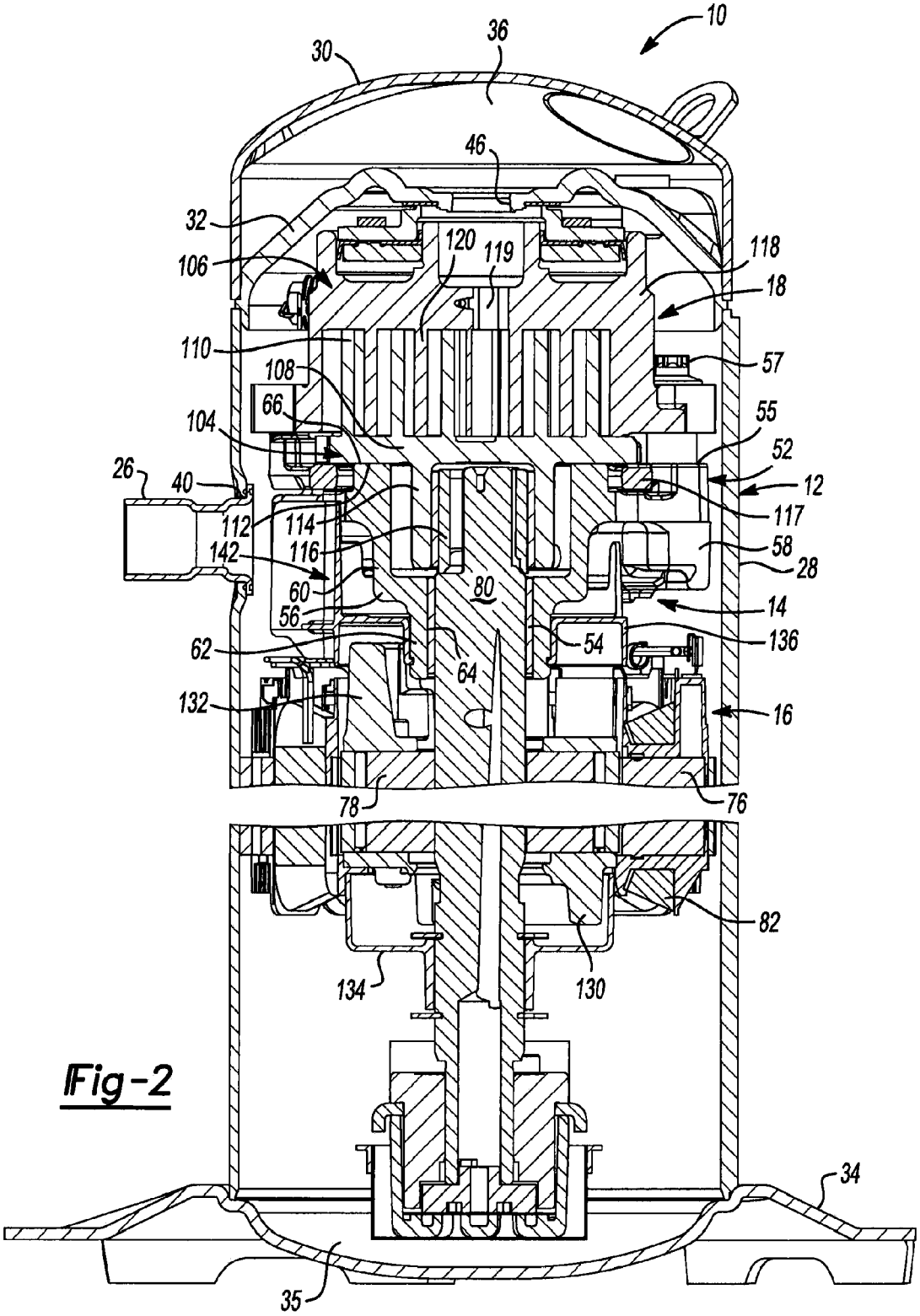
FIG. 2 is a is a cross-sectional view of the compressor of FIG. 1.

With reference to FIGS. 1 and 2, a compressor 10 is provided and may include a hermetic-shell assembly 12, a main-bearing housing assembly 14, a motor assembly 16, a compression mechanism 18, a refrigerant discharge fitting 22, and a suction gas inlet fitting 26. The compressor 10 may circulate fluid throughout a fluid circuit (not shown) of a refrigeration system, heat pump, or other climate-control system, for example. While the compressor 10 shown in the figures is a hermetic scroll refrigerant-compressor, the present teachings may be suitable for incorporation in many different types of scroll, rotary, and reciprocating compressors, for example, including hermetic machines, open-drive machines and non-hermetic machines.

The shell assembly 12 may house the main-bearing housing assembly 14, the motor assembly 16, and the compression mechanism 18. The shell assembly 12 may generally form a compressor housing and may include a cylindrical shell 28, an end cap 30 at the upper end thereof, a transversely extending partition 32, and a base 34 at a lower end thereof. An oil sump 35 may be disposed at a lower end of the shell 28 and may provide lubricating oil to moving components of the compressor 10 such as, for example, compression mechanism 18. The end cap 30 and partition 32 may cooperate to form a discharge chamber 36 that functions as a discharge muffler for the compressor 10.

The refrigerant discharge fitting 22 may be attached to the shell assembly 12 at an opening 38 in the end cap 30. A discharge valve assembly (not shown) may be located within the discharge fitting 22 and may prevent a reverse-flow condition to prevent fluid from entering the compressor 10 via the discharge fitting 22. The suction gas inlet fitting 26 may be attached to the shell assembly 12 at an opening 40 of the shell 28 and is in fluid communication with an interior of the shell assembly 12. The partition 32 may include a discharge passage 46 therethrough providing communication between the compression mechanism 18 and the discharge chamber 36. The discharge-valve assembly could alternatively be located at or near the discharge passage 46.

Referring now to FIGS. 2-6, the main-bearing housing assembly 14 may be affixed to the shell 28 at a plurality of locations in any suitable manner such as, for example, staking and/or welding. The main-bearing housing assembly 14 may include a main-bearing housing 52, a first bearing 54 disposed therein, bushings 55, and fasteners 57. The main-bearing housing 52 may include a central-body portion 56 having a series of arms 58 extending radially outwardly therefrom, a first hub portion 60, and a second hub portion 62 having an opening 64 extending through the first hub portion 60 and the second hub portion 62. The central-body portion 56 may also include an annular flat thrust bearing surface 66 disposed on an axial end surface thereof. The second hub portion 62 may house the first bearing 54 therein for interaction with a drive shaft 80 of the motor assembly 16. One or more of the arms 58 may include an aperture 70 extending therethrough and receiving the fasteners 57 to attach the compression mechanism 18 to the main-bearing housing 52. Additionally, one of the arms 58 may include a wire guard mounting aperture 71 (FIGS. 3 and 5) extending at least partially therethrough.

Figure 3:
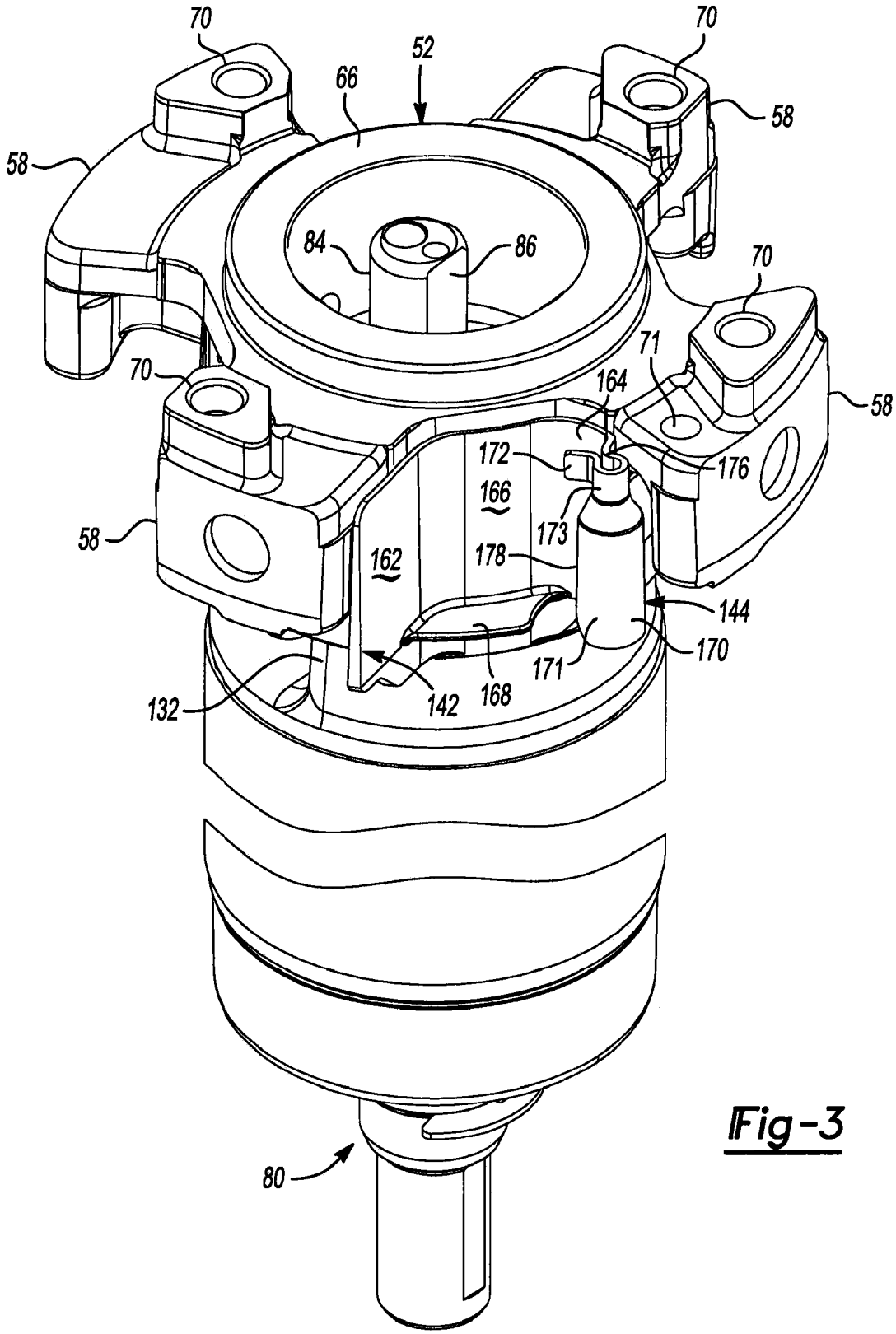
FIG. 3 is a perspective view of a main-bearing housing, a counterweight cover, a drive shaft, and a counterweight according to the principles of the present disclosure.

Referring now to FIGS. 2 and 3, the motor assembly 16 may generally include a motor stator 76, a rotor 78, the drive shaft 80, and windings 82 that pass through the stator 76. The motor stator 76 may be press fit into the shell 28 to fix the stator 76 relative to the shell 28. The drive shaft 80 may be rotatably driven by the rotor 78, which may be press fit on the drive shaft 80. The drive shaft 80 may be rotatably supported by the first bearing 54 and may include an eccentric crank pin 84 having a crank pin flat 86 disposed thereon.

The compression mechanism 18 may generally include an orbiting scroll 104 and a non-orbiting scroll 106. The orbiting scroll 104 may include an end plate 108 having a spiral vane or wrap 110 extending therefrom and an annular flat thrust surface 112. The thrust surface 112 may interface with the thrust bearing surface 66 of the main-bearing housing 52. The orbiting scroll 104 may also include a cylindrical hub 114 that projects downwardly from the thrust surface 112 and engages a drive bushing 116. The drive bushing 116 may include an inner bore in which the crank pin 84 is drivingly disposed. In one configuration, the crank pin flat 86 drivingly engages a flat surface in a portion of the inner bore of the drive bushing 116 to provide a radially compliant driving arrangement.

The non-orbiting scroll 106 may include an end plate 118 having a spiral wrap 120 extending therefrom and a discharge passage 119 extending through the end plate 118. The spiral wrap 120 may cooperate with the wrap 110 of the orbiting scroll 104 to create a series of moving fluid pockets when the orbiting scroll 104 is moved relative to the non-orbiting scroll 106. The pockets created by the spiral wraps 110, 120 decrease in volume as they move from a radially outer position to a radially inner position, thereby compressing the fluid throughout a compression cycle of the compression mechanism 18.

An Oldham coupling 117 may be positioned between orbiting scroll 104 and the main-bearing housing 52 and may be keyed to orbiting scroll 104 and non-orbiting scroll 106. The Oldham coupling 117 transmits rotational forces from the drive shaft 80 to the orbiting scroll 104 to compress a fluid disposed between the orbiting scroll 104 and non-orbiting scroll 106. Oldham coupling 117 and its interaction with orbiting scroll 104 and non-orbiting scroll 106 may be of the type disclosed in assignee's commonly-owned U.S. Pat. No. 5,320,506, the disclosure of which is incorporated herein by reference.

A lower counterweight 130 and/or an upper counterweight 132 may be associated with the motor assembly 16. In one configuration, the counterweight 132 may be fixed to the rotor 78 to facilitate balanced rotation of the drive shaft 80. In another configuration, the lower counterweight 130 and/or the upper counterweight 132 may be fixed to the drive shaft 80 instead of the rotor 78 to facilitate balanced rotation of the drive shaft 80. A lower counterweight shield or cover 134 may at least partially cover the lower counterweight 130 and an upper counterweight shield or cover 136 may at least partially cover the upper counterweight 132. The lower counterweight cover 134 may be mounted to the drive shaft 80 between the lower counterweight 130 and the oil sump 35 and may restrict oil from the oil sump 35 from splashing, splattering or otherwise flowing onto the lower counterweight 130. Preventing oil from flowing onto the lower counterweight 130 reduces viscous drag on the lower counterweight 130 and the motor assembly 16 and reduces oil circulation by shielding the oil from the windage of the lower counterweight 130. The lower counterweight cover 134 may be of the type disclosed in Assignee's commonly owned U.S. Pat. No. 5,064,356, the disclosure of which is hereby incorporated by reference.

Referring now to FIGS. 3-9, the upper counterweight cover 136 may be mounted to the main-bearing housing 52. The upper counterweight cover 136 may include a generally annular body 138, one or more anti-rotation features 140, a suction baffle 142, and a wire guide 144, all of which may be integrally formed as a single, unitary body. The unitary construction of the upper counterweight cover 136 reduces the number of components of the compressor 10, thereby reducing the complexity and cost associated with design and manufacturing of the compressor 10. The upper counterweight cover 136 may be formed from a polymeric, metallic, or ceramic material, for example, or any other suitable material or combination of materials. The upper counterweight cover 136 may be formed from an injection-molding process, for example, and/or any other molding, forming, or machining process or combination of processes.

The annular body 138 may include a recess 146 defined by an outer circumferential portion 148, an inner radial portion 150 and a generally flat upper portion 149. The upper portion 149 may extend between the outer circumferential portion 148 and the inner radial portion 150 and generally perpendicular thereto. The upper portion 149 may include an upper surface 153 and a lower surface 152. The inner radial portion 150 may include a plurality of resiliently flexible fingers 154 extending away from the upper portion 149. Each of the flexible fingers 154 may include an inwardly extending lip 156 that engages a groove 158 formed in the second hub portion 62 of the main-bearing housing 52 via a snap fit, for example.

As described above, the second hub portion 62 may house the first bearing 54, which rotatably supports the drive shaft 80. The upper counterweight 132 may be fixed to the drive shaft 80 and may rotate therewith at least partially within the recess 146 of the upper counterweight cover 136. In this manner, the outer circumferential portion 148 at least partially shrouds the upper counterweight 132 to reduce or prevent the upper counterweight 132 from spreading oil radially outward during rotation of the drive shaft 80. Further, the upper counterweight cover 136 shields the motor assembly 16 from fluids disposed within the compressor 10, such as oil and refrigerant, for example.

Figure 4:
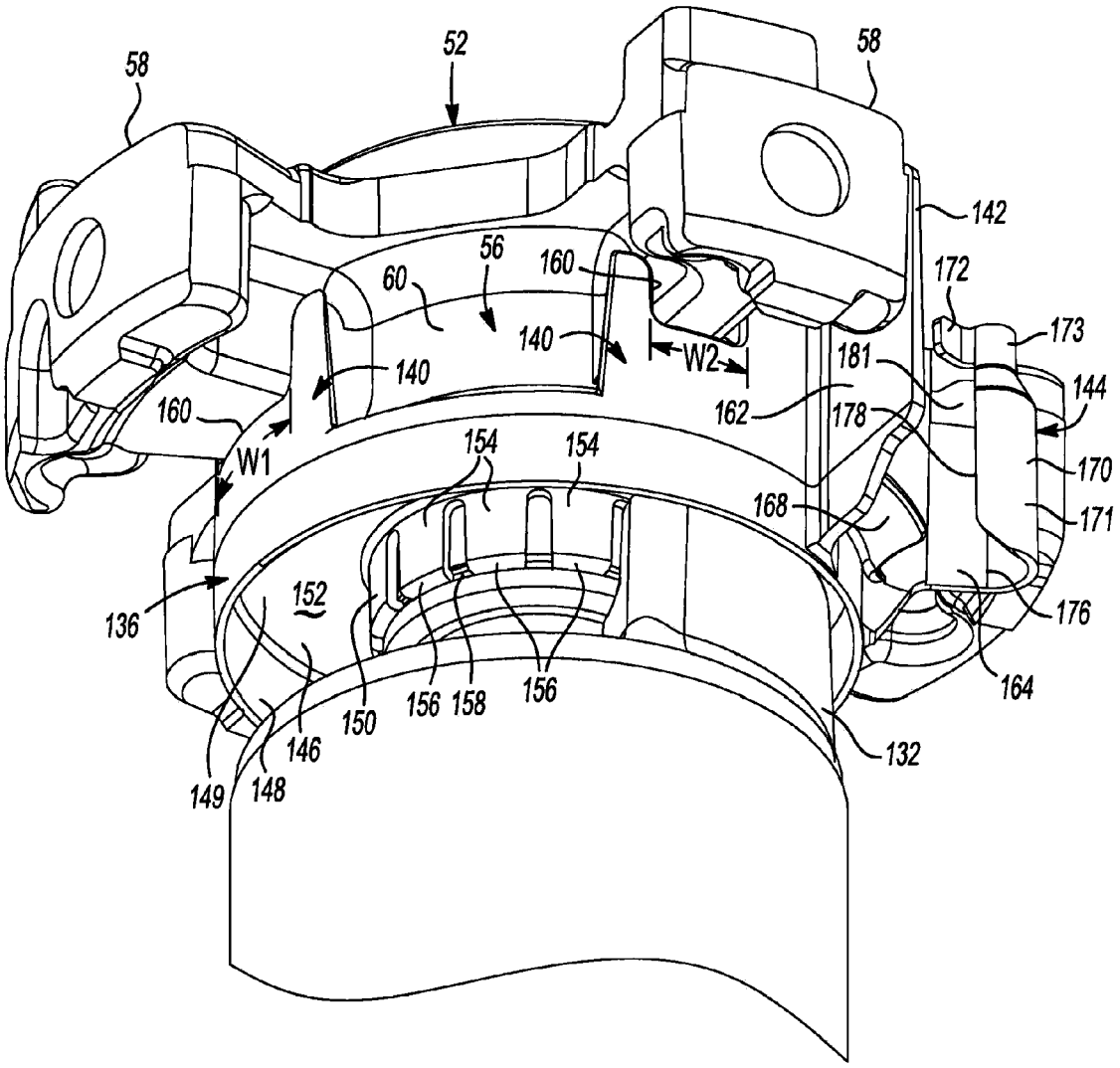
FIG. 4 is a perspective view of the main-bearing housing and counterweight cover of FIG. 3.
Figure 5:
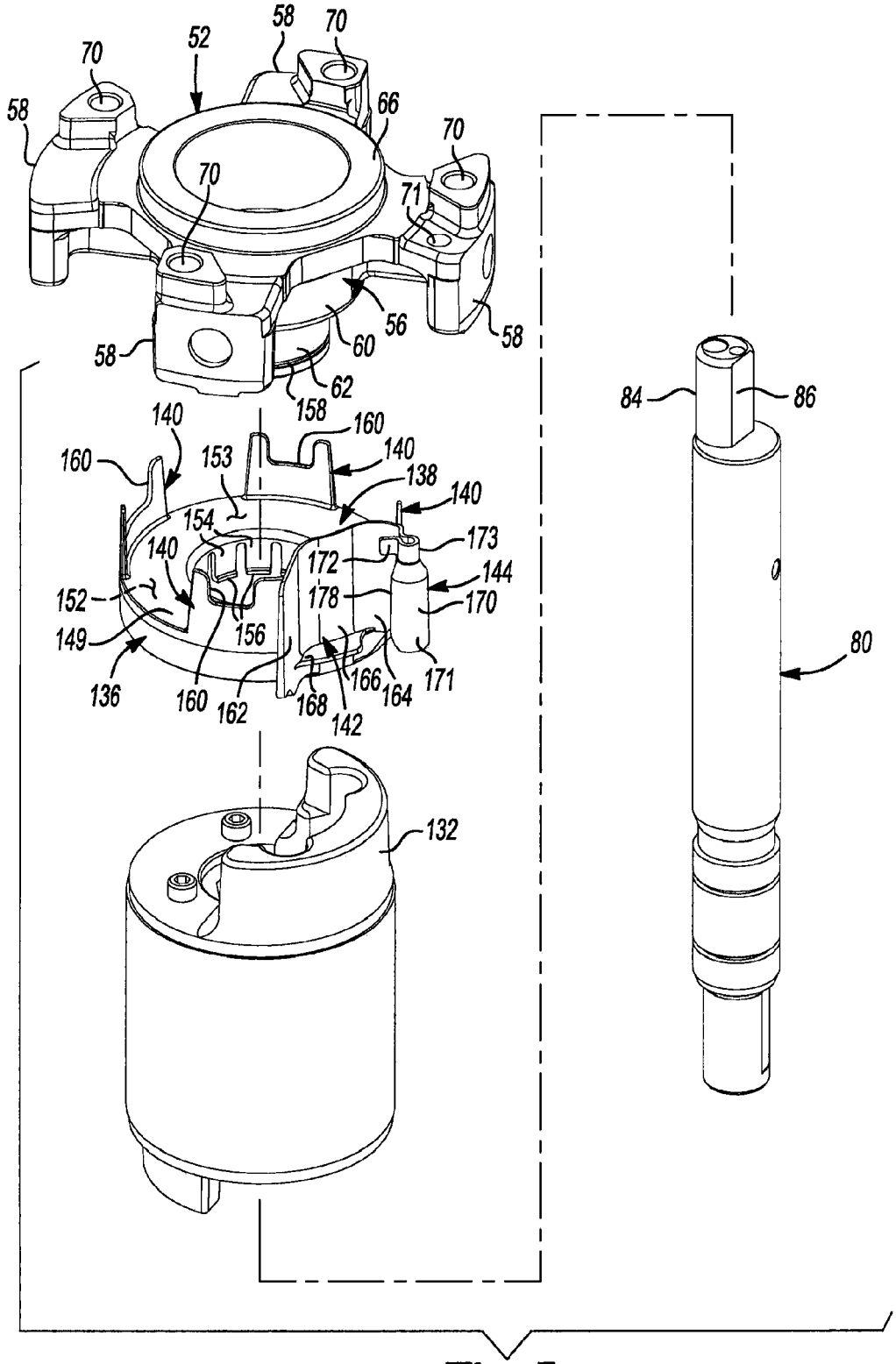
FIG. 5 is an exploded view of the components of FIG. 3.
Figure 6:
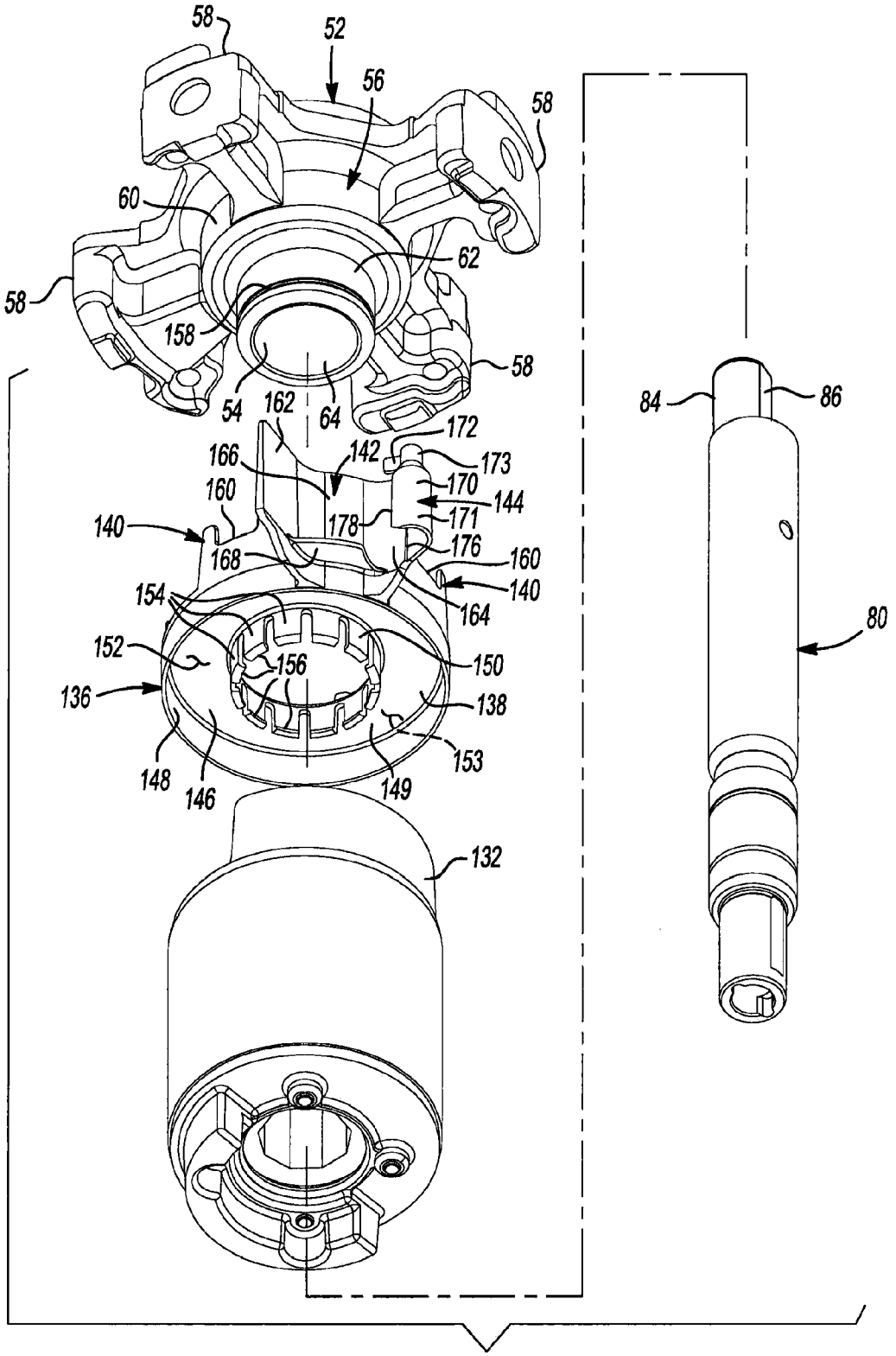
FIG. 6 is an exploded view of the components of FIG. 3.

The anti-rotation features 140 may extend from the outer circumferential portion 148 and/or the upper surface 153 to the plurality of arms 58 of the main-bearing housing 52. In the particular embodiment illustrated, the upper counterweight cover 136 includes four anti-rotation features 140, each one corresponding to one of the four radially extending arms 58 of the main-bearing housing 52. Each of the anti-rotation features 140 may include a cutout 160 having a generally rectangular shape that is sized and shaped to receive a portion of the corresponding arm 58 (as shown in FIG. 4), thereby preventing relative rotation between the upper counterweight cover 136 and the main-bearing housing 52. A width W1 of a first one or more of the cutouts 160 may differ from a width W2 of a second one or more of the cutouts 160 (FIG. 4). Additionally or alternatively, the angular spacing between a particular cutout 160 and a first adjacent cutout 160 may be a first angle, while the angular spacing between the particular cutout 160 and a second adjacent cutout 160 may be a second angle that may be larger or smaller than the first angle. The differing widths W1, W2 and/or angular spacing between the cutouts 160 may correspond to differing widths and/or angular spacing of a particular one or more of the arms 58 of the main-bearing housing 52. In this manner, differing widths W1, W2 and/or angular spacing between the plurality of cutouts 160 prevents the upper counterweight cover 136 from being assembled onto the main-bearing housing 52 in an incorrect orientation and ensures that the suction baffle 142 and wire guide 144 are positioned in the proper orientation with respect to the suction inlet fitting 26, for example.

While the cutouts 160 are described above as being rectangular, the cutouts 160 could alternatively be formed in any other shape, such as triangular, trapezoidal, or arcuate, for example. In other embodiments, the anti-rotation features 140 may include pegs, pins or other features that engage the arms 58 of the main-bearing housing 52 and prevent relative rotation between the upper counterweight cover 136 and the main-bearing housing 52. While the anti-rotation features 140 are described above as being integrally formed with the upper counterweight cover 136, the anti-rotation features 140 could alternatively be separate members mounted to the annular body 138, the suction baffle 142, and/or the wire guide 144.

Figure 7:
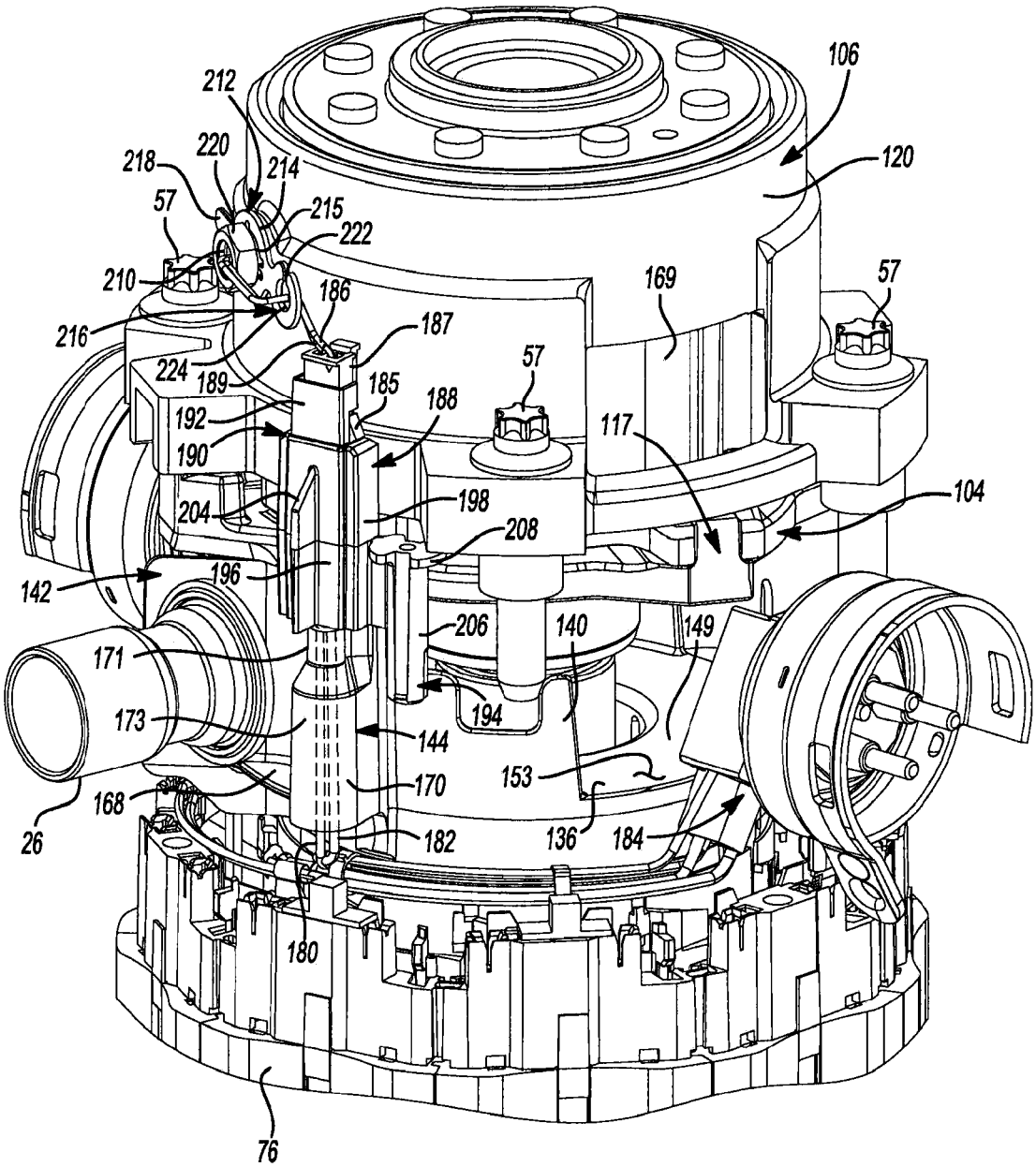
FIG. 7 is a partial perspective view of a compressor including a suction baffle and wire guide.

The suction baffle 142 may include a first face 162, a second face 164, and a third face 166. The first, second and third faces 162, 164, 166 may be generally flat or curved members with the third face 166 connecting the first and second faces 162, 164. The first and second faces 162, 164 may be obtusely angled relative to the third face 166 while the third face 166 may be generally tangent to the outer circumferential portion 148 of the annular body 138. The third face 166 may be positioned at an angle relative to the opening 40 of the suction gas inlet fitting 26, such that the suction baffle 142, as a whole, may be positioned at an angle relative to the suction gas inlet fitting 26 (FIG. 7). A lip 168 may extend radially outwardly from the annular body 138 to protect the motor assembly 16 from debris and otherwise direct incoming refrigerant within the shell assembly 12. While the suction baffle 142 is described above as being integrally formed with the upper counterweight cover 136, the suction baffle 142 could alternatively be a separate component mounted to the annular body 138 or the main-bearing housing 52, for example. Further, while the annular body 138 is described and shown as including a lip 168, the lip 168 may be obviated if the suction baffle 142 sufficiently protects the motor assembly 16 from debris.

The suction baffle 142 directs the flow of suction gas entering the shell 28 through the suction gas inlet fitting 26 towards a suction window 169 (FIG. 7) of the spiral wraps 110, 120 for compression. The suction gas deflects off of the first, second and/or third faces 162, 164, 166 and away from the upper counterweight 132. In so doing, the suction baffle 142 reduces or eliminates interaction between the upper counterweight 132 and the suction gas and therefore reduces the drag experienced by the counterweight during rotation. Additionally, the suction baffle 142 may direct the suction gas away from the motor assembly, thereby reducing heat transfer between the motor assembly 16 and the suction gas.

Oil mixed in with the suction gas may contact the suction baffle 142 and subsequently drip down into the oil sump 35. In another configuration, the lip 168 may extend outwardly and downwardly (relative to the view shown in FIG. 3) and may be oriented relative to the suction gas inlet fitting 26 to allow the lip 168 to deflect a portion of the suction gas downward to cool the motor assembly 16.

The wire guide 144 may be integrally formed with the second face 164 of the suction baffle 142 and may include a generally tubular portion 170 and a tab 172 extending therefrom. The tubular portion 170 may include a first portion 171 and a second portion 173 having a smaller diameter than the first portion 171. A distal end of the second face 164 may curl inward to form the tubular portion 170 of the wire guide 144 such that the tubular portion 170 is integrally formed with the second face 164.

The tubular portion 170 includes a first end 176 extending from the distal end of the second face 164 and a second end 178 that may be spaced less than 360 degrees apart from the first end 176 (FIGS. 3 and 4). That is, the tubular portion 170 may be a discontinuous or open-sided tube such that the second end 178 is spaced apart from the suction baffle 142, thereby forming an opening 181 (FIG. 4). The tab 172 may extend from the second end 178 of the tubular portion 170.

While the wire guide 144 is described above as being integrally formed with the second face 164, the wire guide 144 could alternatively be integrally formed with the first face or third face 162, 166. In other embodiments, the wire guide 144 may be a separate component mounted to the annular body 138, one of the anti-rotation features 140, the suction baffle 142, the stator 76, the shell 28 or any other suitable location.

Thermistor wires 180, 182 may extend between an electrical connection terminal 184 and scroll thermistor lead wires 186, 189 (FIG. 7). The thermistor wires 180, 182 may be connected to a first connector 185, and the scroll thermistor lead wires 186, 189 may be connected to a second connector 187. The thermistor wires 180, 182 may be routed along stator 76 and up through the tubular portion 170. The tubular portion 170 may locate and protect the thermistor wires 180, 182 within the shell 28 to allow the thermistor wires 180, 182 to be connected to the scroll thermistor lead wires 186, 189 via mating connectors 185, 187 received in a thermistor wire guard 188.

The tab 172 may be gripped by an assembly or repair technician and pulled away from the suction baffle 142 to spread the tubular portion 170 open, thereby allowing easy insertion and removal of the thermistor wires 180, 182 into and out of the tubular portion 170. While the wire guide 144 is described as positioning thermistor wires 180, 182, the wire guide 144 may also be used to route other wires within the shell 28 instead of or in addition to the thermistor wires 180, 182 such as, for example, lines supplying power to the motor assembly 16, a valve (not shown), or any other electrical device within the compressor 10.

Figure 8:
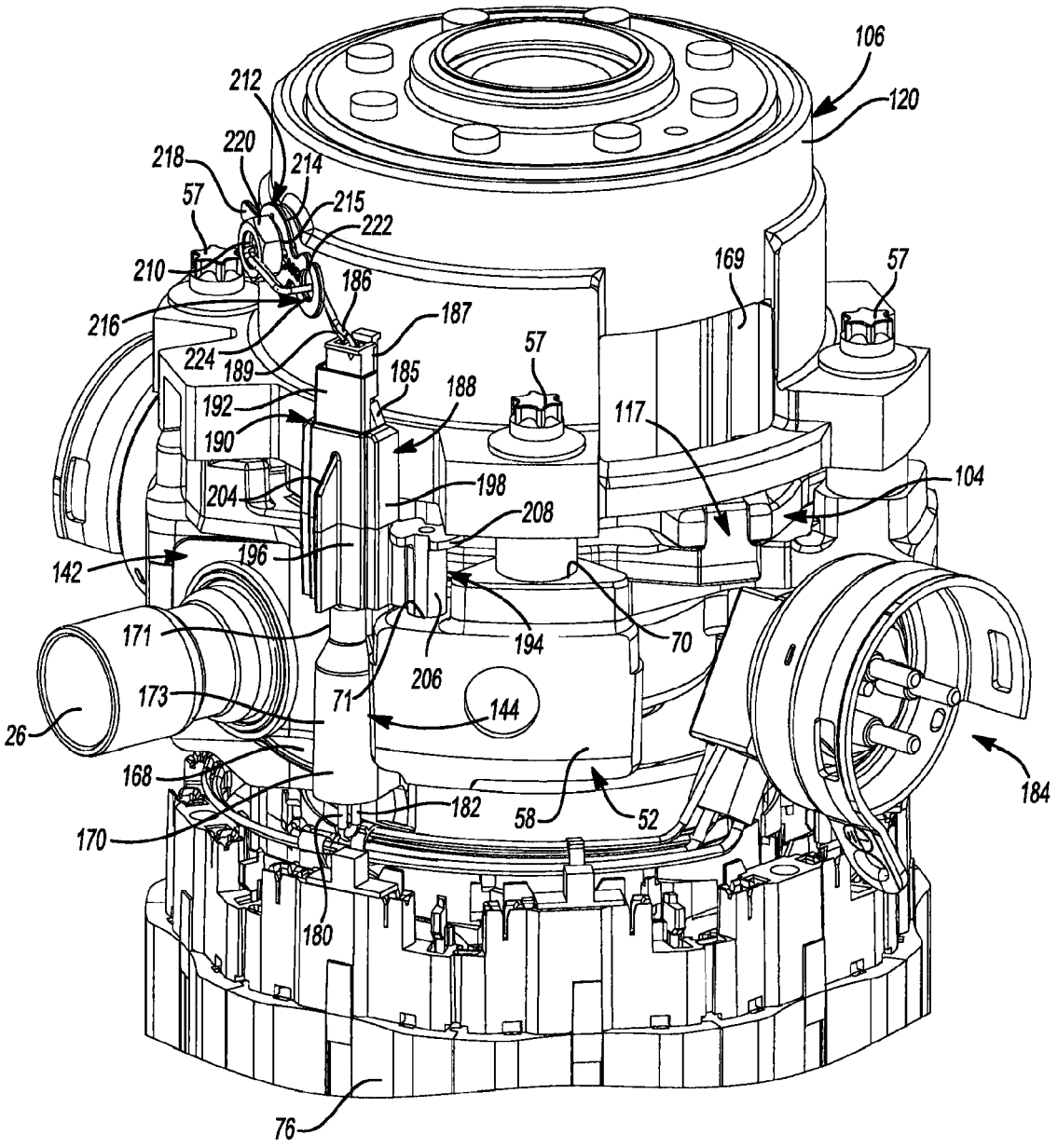
FIG. 8 is a partial perspective view of the compressor of FIG. 7 including a main-bearing housing.
Figure 9:
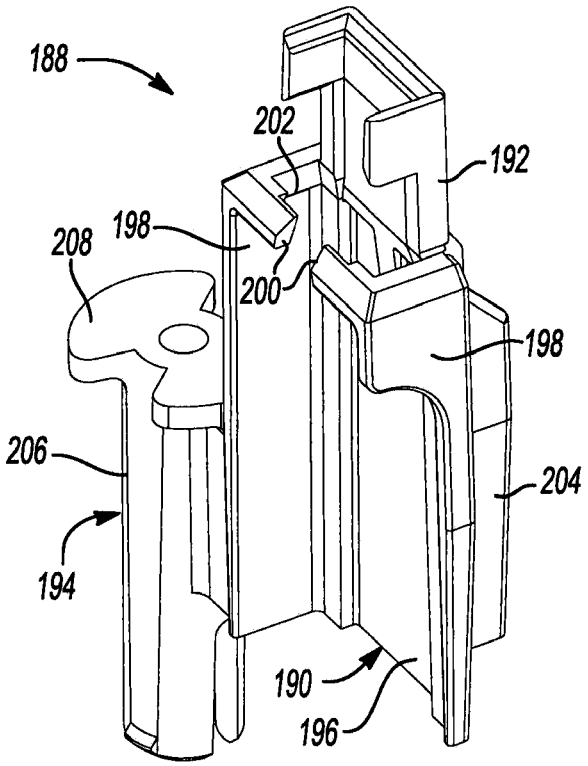
FIG. 9 is a perspective view of a wire guard according to the principles of the present disclosure.

Referring now to FIGS. 7-9, the thermistor wire guard 188 may include a body portion 190, a collar 192, and a mounting stud 194. The thermistor wire guard 188 may be injection molded or otherwise formed from a polymeric material, for example, and may facilitate assembly of the thermistor wires 180, 182 to the scroll thermistor lead wires 186, 189. The thermistor wire guard 188 may cooperate with the wire guide 144 to protect and route the thermistor wires 180, 182. In one configuration, the thermistor wire guard 188 and the wire guide 144 may be integrally formed as a single unitary component.

The body portion 190 may include a back wall 196, side walls 198, one or more retaining members 200, a panel mount opening 202, and a rib 204 protruding from the back wall 196. The panel mount opening 202 may be defined by the back wall 196, the side walls 198, and the one or more retaining members 200. The thermistor wires 180, 182 may be routed from the tubular portion 170 of the wire guide 144 up through the body portion 190 of the thermistor wire guard 188. The panel mount opening 202 may receive and securely retain the first connector 185 via a snap-fit engagement, for example. The collar 192 may locate and guide the second connector 187 into engagement with the first connector 185, and prevent improper engagement therebetween.

The rib 204 may engage an inner surface the shell 28 (FIGS. 1 and 2) and maintain a spaced apart relationship between the shell 28 and the thermistor wires 180, 182. In this manner, the rib 204 and back wall 196 may cooperate to protect the thermistor wires 180, 182 from damage that could occur due to contact with moving parts such as the orbiting scroll 104 or the Oldham coupling 117, damage due to contact with the shell 28 during operation of the compressor 10, or damage due to contact with the shell while the end cap 30 (FIG. 1) is being welded onto the shell 28.

The mounting stud 194 may be integrally formed with the body portion 190 and may include a stud portion 206 and a head portion 208. The stud portion 206 may be slip-fit or otherwise received into the wire guard mounting aperture 71 in the main-bearing housing 52 to fix and position the thermistor wire guard 188 relative to the main-bearing housing 52. The head portion 208 may facilitate installation of the mounting stud 194 onto the main-bearing housing 52 and may provide a stop to engage the non-orbiting scroll 106, thereby preventing disengagement between the mounting stud 194 and the main-bearing housing 52.

The scroll thermistor lead wires 186, 189 may extend between the second connector 187 and a scroll thermistor 210, which may be connected to the non-orbiting scroll 106. The scroll thermistor 210 may communicate with the discharge passage 119 (FIG. 2) and may monitor a temperature of a discharge fluid flowing therethrough. Alternatively, the scroll thermistor 210 may communicate with a fluid pocket defined by the spiral wraps 110, 120 of the orbiting and non-orbiting scrolls 104, 106, respectively, and may monitor a temperature of the fluid disposed therein.

A lanyard 212 may be employed to prevent any slack in the scroll thermistor lead wires 186, 189 from contacting the shell 28, thereby preventing insulation on the scroll thermistor lead wires 186, 189 from being damaged while the end cap 30 is welded onto the shell 28. The lanyard 212 may be formed from nylon or other polymeric material and may include a body portion 214, a clip 216, and a flag 218. The body portion 214 may include a mounting aperture 215 engaging the scroll thermistor 210 generally between a head 220 of the thermistor 210 and the non-orbiting scroll 106. In the configuration shown in FIG. 8, the head 220 of the thermistor 210 is shown as including a generally hex shape and the body portion 214 is shown as being captured under the hex head and retained thereon via a snap fit.

The clip 216 may be a generally C-shaped member extending from the body portion 214. The clip 216 may include a slot 222 in communication with a clip aperture 224. The scroll thermistor lead wires 186, 189 may be received through the slot 222 and into the clip aperture 224, thereby retaining the scroll thermistor lead wires 186, 189 in place and preventing contact between the scroll thermistor lead wires 186, 189 and the shell 28.

The flag 218 may extend from the body portion 214 and may be disposed approximately 180 degrees apart from the clip 216. The flag 218 may be in an engaged position (shown in FIGS. 7 and 8) when the clip 216 is engaging the scroll thermistor lead wires 186, 189. The engaged position may be a generally horizontal position, as shown in FIGS. 7 and 8, or alternatively, may be positioned at an angle relative to the clip 216. When the clip 216 is not engaged with the scroll thermistor lead wires 186, 189, the lanyard 212 may be allowed to rotate about the center of the mounting aperture 215 out of the engaged position and into a disengaged position (not shown) due to an imbalance of weight between the clip 216 and the flag 218. A sensing system (not shown) may be used during assembly of the compressor 10 to determine whether the flag is in the engaged position, thereby determining whether the clip 216 is engaged with the scroll thermistor lead wires 186, 189.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A counterweight cover for a compressor comprising:

an annular body having an outer circumferential portion, an inner circumferential portion opposing said outer circumferential portion, and an upper portion, said inner circumferential portion being spaced apart from and connected to said outer circumferential portion by said upper portion to define a recess, said recess bounded between said upper portion, said inner circumferential portion and said outer circumferential portion and disposed between a compression mechanism and a motor of the compressor; and a suction baffle disposed on said annular body and operable to direct a flow of suction gas within the compressor;

wherein said upper portion is monolithically formed with said outer circumferential portion and said inner circumferential portion.

2. The counterweight cover of claim 1, further comprising a wire guide receiving at least one wire to position said at least one wire relative to said annular body.

3. The counterweight cover of claim 2, wherein said wire guide is integrally formed with the counterweight cover.

4. The counterweight cover of claim 1, wherein said inner circumferential portion is attached to a main-bearing housing.

5. The counterweight cover of claim 4, wherein said inner circumferential portion is snap fit to said main-bearing housing.

6. The counterweight cover of claim 1, wherein said inner circumferential portion includes a plurality of flexible fingers engaging a groove disposed in a main-bearing housing to attach said annular body to said main-bearing housing.

7. The counterweight cover of claim 1, further comprising at least one anti-rotation feature preventing relative rotation between the counterweight cover and a main-bearing housing.

8. The counterweight cover of claim 7, wherein said at least one anti-rotation feature includes keyed members extending outwardly from said annular body, said at least one anti-rotation feature aligning said annular body relative to said main-bearing housing.

9. The counterweight cover of claim 1, wherein said suction baffle is integrally formed with said annular body.

10. The counterweight cover of claim 9, further comprising a wire guide integrally formed with said suction baffle.

11. The counterweight cover of claim 1, wherein said suction baffle includes a lip allowing suction gas to flow in a first direction and preventing oil circulation in a second direction.

12. A compressor comprising: a motor assembly at least partially supported by a main-bearing housing; a counterweight cover fixed to said main-bearing housing and including an inner circumferential portion and an outer circumferential portion that cooperate to define a recess, said inner circumferential portion and said outer circumferential portion being coaxially aligned and opposing one another such that said recess is bounded between sa4eLan outer surface of said inner circumferential portion and an inner surface of said outer circumferential portion; a counterweight associated with said motor assembly and at least partially disposed between said inner circumferential portion and said outer circumferential portion within said recess; a suction baffle integrally formed with said counterweight cover and including a concave surface facing an inlet passage of the compressor, said concave surface being adapted to redirect a flow of suction gas from said inlet passage and facing away from said inner surface of said outer circumferential portion; and a wire guide integrally formed with said counterweight cover.

13. The compressor of claim 12, wherein said wire guide receives at least one wire to position said at least one wire relative to said counterweight cover.

14. The compressor of claim 12, further comprising a wire guard cooperating with said wire guide to protect and route at least one wire.

15. The compressor of claim 14, wherein said wire guard includes a mounting stud engaging said main-bearing housing.

16. The compressor of claim 14, wherein said wire guard includes a rib adapted to maintain a spaced apart relationship between said at least one wire and a shell of the compressor.

17. The compressor of claim 14, further comprising a lanyard including a flag portion and a clip portion retaining a lead wire connected to said at least one wire.

18. The compressor of claim 12, wherein the inner circumferential portion of said counterweight cover is snap fit to a hub of said main-bearing housing.

19. The compressor of claim 12, wherein said counterweight cover includes a plurality of flexible fingers engaging a groove disposed in said main-bearing housing to attach said counterweight cover to said main-bearing housing.

20. The compressor of claim 12, further comprising at least one anti-rotation feature preventing relative rotation between said counterweight cover and said main-bearing housing.

21. The compressor of claim 20, wherein said at least one anti-rotation feature includes keyed members extending outwardly from said counterweight cover, said at least one anti-rotation feature aligning said counterweight cover relative to said main-bearing housing.

22. The compressor of claim 12, wherein said counterweight is attached to one of a driveshaft and a rotor of said motor assembly.

23. The counterweight cover of claim 1, wherein said recess is operable to receive a counterweight therein.

24. A compressor comprising: a motor assembly at least partially supported by a main-bearing housing; a counterweight cover fixed to said main-bearing housing and including an inner circumferential portion and an outer circumferential portion that cooperate to define a recess, said inner circumferential portion and said outer circumferential portion being coaxially aligned and opposing one another such that said recess is bounded between said inner circumferential portion and said outer circumferential portion; a counterweight associated with said motor assembly and at least partially disposed between said inner circumferential portion and said outer circumferential portion within said recess; a suction baffle integrally formed with said counterweight cover; a wire guide integrally formed with said counterweight cover; and a wire guard cooperating with said wire guide to protect and route at least one wire and including a mounting stud engaging said main-bearing housing.

25. The compressor of claim 24, wherein said suction baffle includes a concave surface facing an inlet passage of the compressor, said suction baffle being adapted to redirect a flow of suction gas from said inlet passage.

26. The compressor of claim 24, wherein said wire guide receives at least one wire to position said at least one wire relative to said counterweight cover.

27. The compressor of claim 24, wherein said wire guard includes a rib adapted to maintain a spaced apart relationship between said at least one wire and a shell of the compressor.

28. The compressor of claim 24, further comprising a lanyard including a flag portion and a clip portion retaining a lead wire connected to said at least one wire.

29. The compressor of claim 24, wherein the inner circumferential portion of said counterweight cover is snap fit to a hub of said main-bearing housing.

30. The compressor of claim 24, wherein said counterweight cover includes a plurality of flexible fingers engaging a groove disposed in said main-bearing housing to attach said counterweight cover to said main-bearing housing.

31. The compressor of claim 24, further comprising at least one anti-rotation feature preventing relative rotation between said counterweight cover and said main-bearing housing.

32. The compressor of claim 31, wherein said at least one anti-rotation feature includes keyed members extending outwardly from said counterweight cover, said at least one anti-rotation feature aligning said counterweight cover relative to said main-bearing housing.

33. The compressor of claim 24, wherein said counterweight is attached to one of a driveshaft and a rotor of said motor assembly.

* * * * *